United States Patent [19]

Mohr

[11] Patent Number: 4,463,948

[45] Date of Patent: Aug. 7, 1984

[54] EXERCISER WITH CROSS-STRAND MEANS JOINED BY CROSS-KNOTS

[76] Inventor: Robert B. Mohr, Southgate Tower #12B, 371 Seventh Ave., New York, N.Y. 10001

[21] Appl. No.: 394,020

[22] Filed: Jun. 30, 1982

[51] Int. Cl.[3] ..... A63B 21/04

[52] U.S. Cl. ..... 272/136; 272/900; 272/137; 272/142

[58] Field of Search ..... 272/135, 136, 137, 138, 272/142, 900, 125

[56] References Cited

U.S. PATENT DOCUMENTS

| | | | |
|---|---|---|---|
| 3,300,210 | 1/1967 | Melchiona | 272/125 |
| 3,807,730 | 4/1974 | Dalton et al. | 272/135 |

FOREIGN PATENT DOCUMENTS

| | | | |
|---|---|---|---|
| 712937 | 7/1965 | Canada | 272/142 |
| 1421162 | 1/1965 | France | 272/900 |

*Primary Examiner*—Richard T. Stouffer
*Assistant Examiner*—William H. Honaker
*Attorney, Agent, or Firm*—Paul J. Sutton

[57] ABSTRACT

An exercise device includes a single elastic strand which is disposed to provide a pair of opposed, elongated, elastic side strands and elastic end cross-strands joining the side strands. A plurality of elastic, inner, cross-strands join the side strands at pre-selected intervals between the end cross strands. The inner cross strands include adjoining portions of the opposed elongated side strands. Grips enclose the end cross strands and inner cross strands.

6 Claims, 10 Drawing Figures

EXERCISER WITH CROSS-STRAND MEANS JOINED BY CROSS-KNOTS

The present invention relates generally to an exercising apparatus of the stretchable type, and more particularly, flexible biasable exercising apparatus for exerting a person's arms and legs for strengthening or therapeutic purposes.

Biasable, flexible exercise apparatus of various types that can be used to strengthen a person's arms or legs by creating resistance as the exerciser is pulled apart and by a person creating resistance in the arms or legs as the exercise apparatus draws itself back into its unbiased position are known in the art. These types of apparatus each have various types of advantages and accompanying disadvantages. Some, like spring-loaded opposite-directional pulls use compression springs. Others are of various types of elastic rubber, or elastomer having a number of configurations. These prior art exercise apparatus have one or more disadvantages of being excessively costly for results, lack of adaptability to various exercises such as inadaptability for both stretching and twisting, or being too heavy for being applicable to both pure strengthening exercises and to specialty exercising, such as for increasing ball throwing strength. Excessive cost for the results obtained is another common attribute of exercise apparatus.

The present invention contemplates the elimination of the disadvantages of the prior art by providing an apparatus having a novel arrangement and construction that meets the various needs of a user for a low cost.

Accordingly, it is an object of my invention to provide a novel exercising apparatus that is lightweight, flexible, and biasable.

It is another object of this invention to provide an exercising apparatus that is adaptable to varied purposes.

It is yet another object of this invention to provide an exercising apparatus that can be used by a user ro exercise arms or legs at various exerciser lengths abd positions at the option of the user.

It is a further object of my invention to provide a flexible biasable exerciser apparatus that comprises a single piece of elastic rubber or elastomer connected together in a series of ladder units with grips at each unit, the entire series of units being adaptable to varied arm and leg exercises.

It is yet another object of this invention to provide elastic exerciser apparatus that can be assembled from a single elongated elastic tubular strand and gripping means.

It is a further object of this invention to provide a sturdy, very inexpensive, very adaptable, and very lightweight exercise apparatus that is very inexpensive.

It is yet a further object of my invention to provide an elastic exerciser one end of which is capable of being removable connected to the top or bottom of a door as a brace for exercise by the user. o provide an elastic exercise apparatus that has a pair of elongated side strands joined at intervals by a plurality of cross strands that are double strands, enclosed by gripping means.

It is a further object of this invention to provide an elastic exercise apparatus that can be attached to the edge of a door for providing resistance for the user to exercise from.

The present invention fulfils the above objects and overcomes limitations and disadvantages of prior art by providing a novel exercise apparatus that comprises a pair of opposed elongated side strands comprising, a plurality of elastic side strand portions, a pair of elastic end cross-strands joining the ends of the elongated side strands, a plurality of elastic inner cross-strand means joining the side strands at intervals between the end cross-strands, and a plurality of gripping means enclosing the end cross strands and the inner cross-strands means for providing grips for a user. The inner cross-strand means include a double strand for strength. All the strands are preferably made of a single elastic tubular strand having two ends. The single strand is joined at each inner double cross-strand by knot, such as a square knot and is knotted at the ends. The knots are enclosed by the hand grips. Thus, a plurality of flexible, biasable inner units are connected in series with a first and last unit at each end of the series. Each inner unit is made up of a pair of spaced, opposed side strands and a pair of opposed double cross-strands. Single strands can be positioned at each cross strand series end. The strand used is tubular and made of elastic rubber or elastomer. Surgical rubber tubing, for example, can be used.

This invention will be more clearly understood from the following description of specific embodiments of the invention, together with the accompanying drawing, wherein similar reference characters denote similar elements through the several views and in which FIG. 1 is an overall side view of the exercise apparatus showing it in use by a user;

Figure 1:
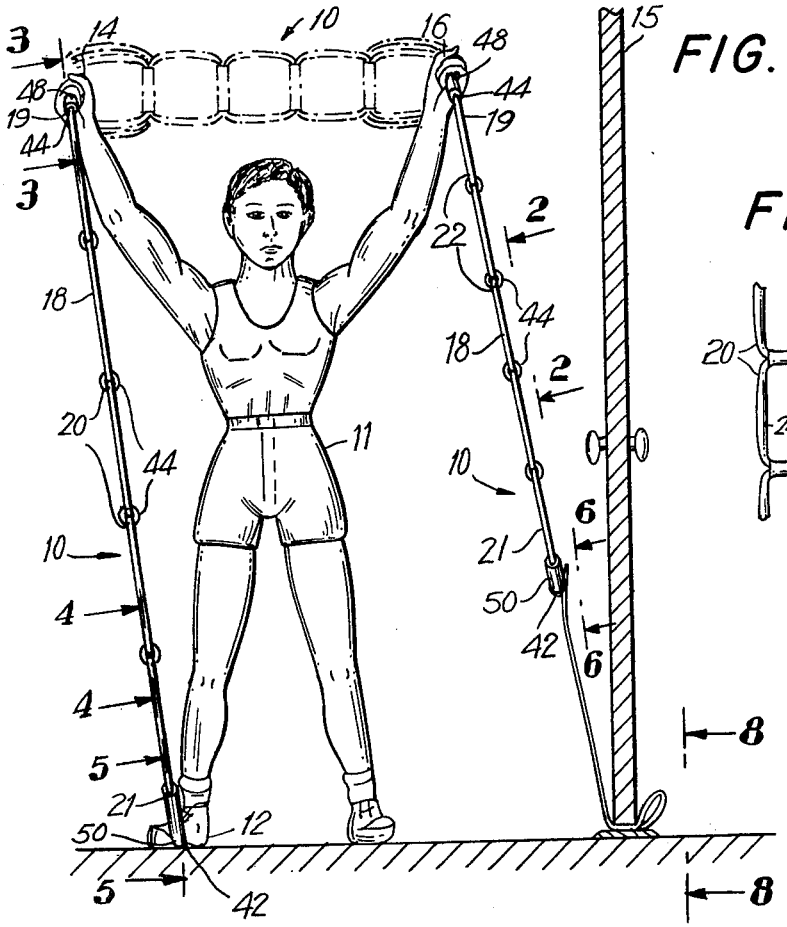

Reference is now made in detail to the drawings where reference numerals are correlated to various elements of the invention as described herein below.

FIG. 1 illustrates a user exercising with anelastic exercise apparatus 10, being operated by a user 11. On the right side of the user apparatus 10 is being flexed between the user's right foot 12 and the user's right hand 14. On the left side of the user apparatus 10 is being flexed between a door 15 and the user's left hand 16. Phantom lines indicate apparatus 10 being stretched between the user's left and right hands 14 and 16. Exercise apparatus 10 is illustrated in all three configurations in the stretched position having been moved from the unstretched position, which is not illustrated. Certain arm and leg muscles are worked in moving apparatus 10 from its unbiased to its biased positions. Further muscles are differently worked as the apparatus is resisted by the user as it draws itself back to the unbiased position.

Figure 2:
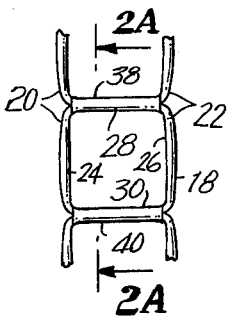
FIG. 2 is a detailed frontal view of one of the flexible units of the apparatus.

FIG. 1 is a general side view of apparatus 10, which is viewed in a detailed front view in FIG. 2, which is taken at a typical one of a continuous series of middle, or inner, units 18 of the apparatus. Two outer units 19 and 21 at opposite ends of apparatus 10, terminate inner units 18 at either end of the apparatus.

Figure 2A:
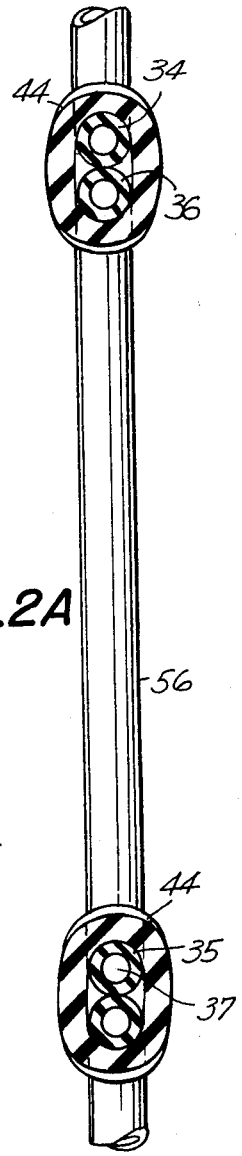
FIG. 2A is a view of the apparatus taken through line 2A—2A of FIG. 1.

FIG. 1 shows one side strand member 20 of a pair of opposed side strand members 20 and 22. Side strand members 20 and 22 comprise a plurality of side strand portions as shown in FIG. 2 as side strand portions 24 and 26. Side strands 20 and 22 extend approximately parallel one to another and are spaced from one another the full length of the apparatus. Strands 20 and 22 are flexible and biasable, that is, are erubber surgical tubing. A cross section of the preferred flexible tubing is shown in FIG. 2A and showing double cross-strands 34 and 36 of an inner cross strand means, to be described. An inner wall 35 of the tubing is shown forming an inner hollow portion 37. The tubular design adds greatly to the flexibility of the apparatus while reducing its strength only slightly.

As shown in FIG. 2 to elastic inner cross-strand means 28 and 30 join side strand portions 24 and 26 at a spaced interval 32. These spaced intervals 32 are preferably regular, depending on the type of exercise the user wishes to perform. FIG. 2A illustrates a detailed side view of FIG. 2 and shows side strand 20 with a cross section of an inner cross-strand means having tubular, elastic cross strand members 34 and 36 in proximity. Cross-strand means 28 and 30 also include tubular grips 38 and 40 that enclose double cross strand members 34 and 36. Grips 38 and 40 are preferably flexible and, besides enclosing cross strand members 34 and 36, are used to provide a hand grip for the user as shown in FIG. 1, or a relatively stronger grip than grips 38 and 40, namely, the reinforced end grip 42 shown in FIG. 1 first at the foot 12 of the user and 2 will be discussed below. As shown in FIG. 1, grips 38 and 40 of FIG. 2 are the same as general hand grips 44 at a plurality of inner cross strand portions 44. First and second end cross grips 48 and 50 surround the end cross strands of side strands 20 and 22 respectively as shown in FIG. 1.

To make the apparatus, one could use techniques well known to those skilled in the art. For example, one could take a single strand 56 of an elastic, tubular material, and dispose a pre-selected length in a central position, thus forming at that length the width of the cross strand of outer unit 21. Equal lengths of strand 56 remain on either side of the pre-selected central lengths. These equal lengths would then be laid out to provide side and cross strands and, preferably, knotted at the cross strands to form the repeating series of open, box-like structures, as shown in FIGS. 1 and 2. At the intermediate, elastic inner cross strands, the preferred knot is a square knot. The last repeat structure terminates the free ends of the single strand in a knot as shown in FIG. 3.

General grips 44, which enclose first end strand 48 and general inner cross strand elements 46, are tubular and preferably flexible and can be made of any comfortable, strong material such as rubber or plastic. General grips 44 are placed approximately parallel one to another. In the novel construction and arrangement described herein, the doubled cross strand members 34 and 36, which are kept in juxtaposition by general grips 44, create added strength to the apparatus. In addition, a safety factor is present, for the jerk of a broken strand will be taken up by the unbroken strand, to the benefit of the user.

Figure 3:
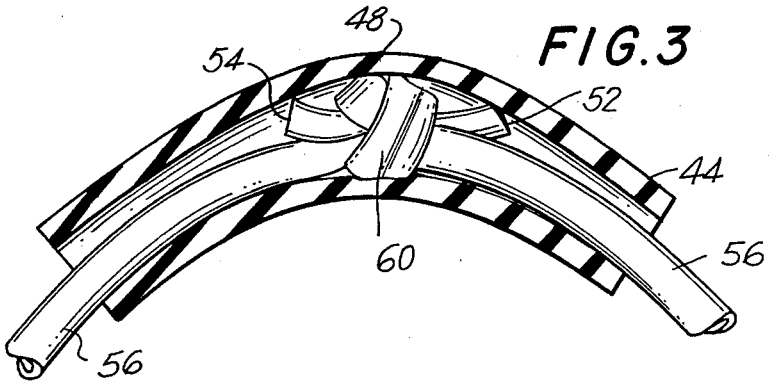
FIG. 3 is a view of the apparatus taken through line 3—3 of FIG. 1.
Figure 4:
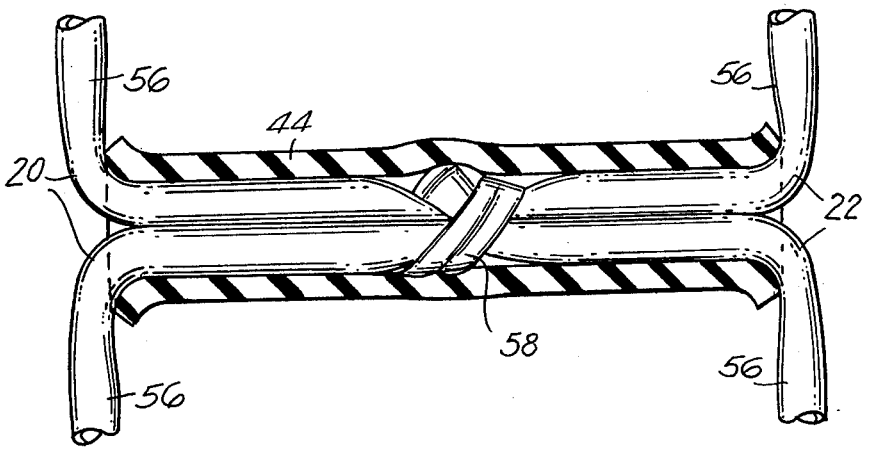
FIG. 4 is a view of the apparatus taken through line 4—4 of FIG. 1.
Figure 5:
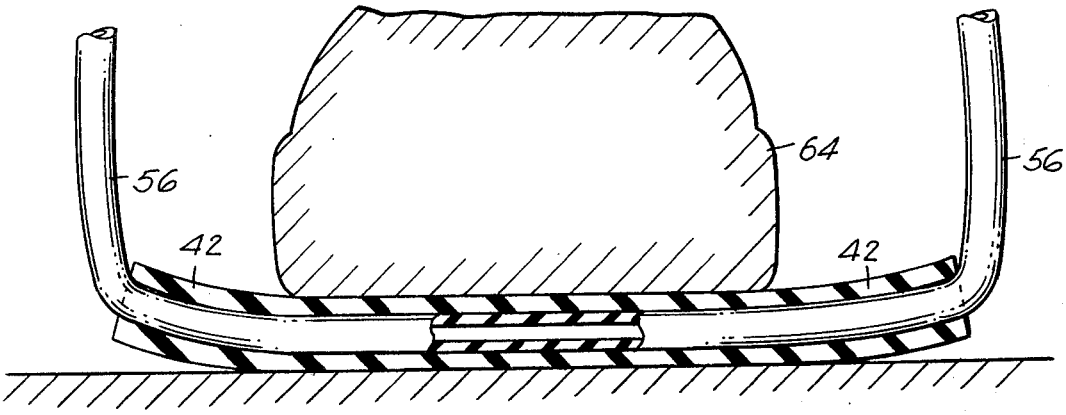
FIG. 5 is a view taken through line 5—5 of FIG. 1.

In the preferred embodiment illustrated, one continuous single strand, generally designated with the numeral 56 in FIGS. 3 and 4, is the preferred construction and arrangement of the novel exerciser apparatus 10. In particular, side strands 20 and 22, made from a series of inner units 18 with the two outer end units 19 and 21 which in series comprise side strands 20 and 22; first and second cross strands 48 and 50; and inner adjoining double cross strand members 34 and 36 are all comprised of single strand 56.

Single strand 56 is joined at each general inner cross strand portion 46 by a cross knot 58, as shown in FIG. 4. Cross rns from its double cross strand formation back to its side strands 22 and 24 and so continues to form the series of strand units 18 leading from first outer unit 19. Last outer unit 21 is formed in the same method as particularly indicated in FIG. 3, where ends 52 and 54 of single strand 56 are connected at final knot 60, which is enclosed by reinforced end grip 42. The use of a single flexible strand for the strand sides, ends and cross strands of the exercise apparatus 10 adds to the strength of the apparatus.

Figure 6:
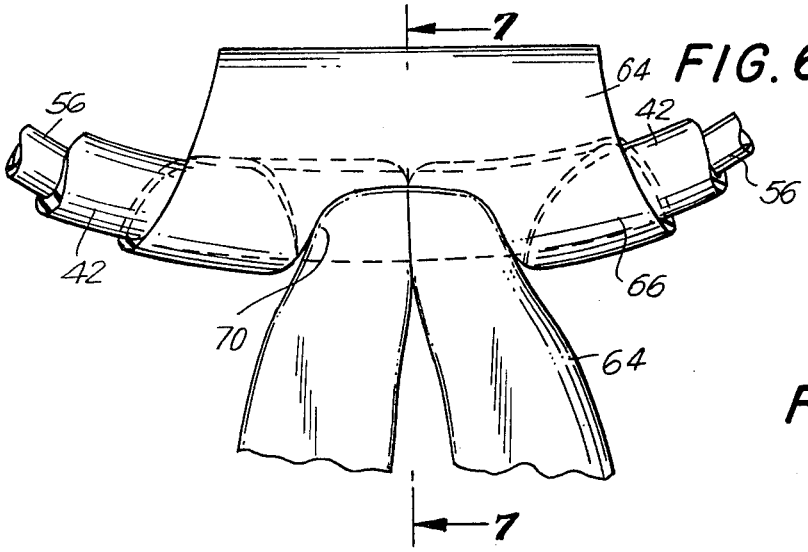
FIG. 6 is a view taken through line 6—6 of FIG. 1.
Figure 7:
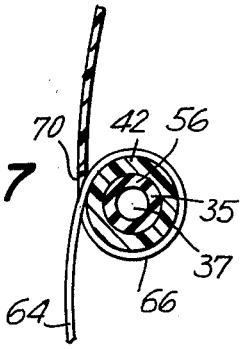
FIG. 7 is a view taken through line 7—7 of FIG. 6.
Figure 8:
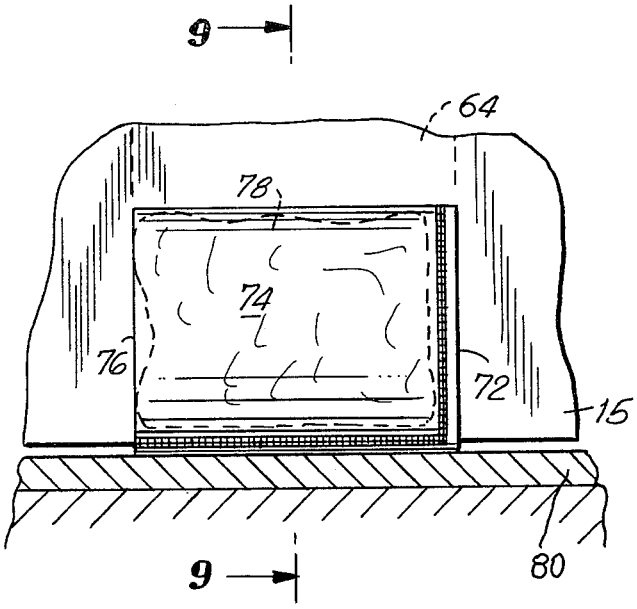
FIG. 8 is a view taken through line 8—8 of FIG. 1.
Figure 9:
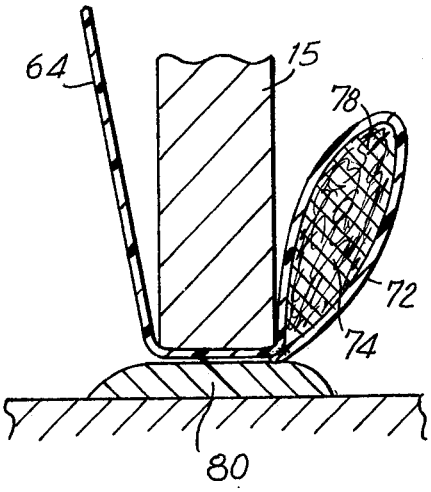
FIG. 9 is a view taken through line 9—9 of FIG. 8.

In accordance with the present invention, a fastener assembly 62 is included for detachably connecting or side of a closed door. Fastener assembly 62 is shown in FIG. 1 connected at one end to reinforced hand grip 42 and at the other end to the bottom of door 15. FIGS. 5,6, 7, 8, and 9 illustrate fastener assembly 62 in detail. A connector 64 encircles grip 14 at wrap 65 and extends to brace 68, which is positioned on the opposite side of closed door 15. Connector 64 is flat and can easily pass over or under a closed door. Connector 64 can be of any light material capable of withstanding stress, and is preferably pliable so that it can be collapsed. As shown in FIG. 6, connector 64 leads to wrap 66, which encloses grip 44 and in particular, an aperture 70 is formed by connector 64. In placing fastener assembly 62 in position around grip 44, wrap 66 is laid under grip 44 and brace 68 is passed over grip 42 and through aperture 70 on the opposite side of grip 42 to form wrap 66. Brace 68 which comprises brace bag 72 forming brace enclosure 74 with open end 76. Filler 78 is used to pack bag 72 to form the actual bracing material to lock brace 68 on the opposite side of the door. Any material, such as a soft plastic, can be used as a filler. When the user wishes to use a firm brace at one end to exercise, fastener assembly 62 is connected preferably to reinforced grip 44 and wrap 66 in particular is connected to reinforced grip 42 and brace bag 72 with filler 78 is set on the opposite side of the top or bottom of a door, which is then closed to a latched position. Thus the user can exercise with one end of exercise apparatus 10 connected to immobile brace 68. FIG. 9 shows brace bag 72 with filler 78 and connector 64 between the bottom of door 15 and doorsill 80. FIG. 8 shows brace bag 72 wedged on the side of door 15 opposite from the user.

In summary, a plurability of flexible, biasable inner units 18 as shown in FIG. 2 are connected in series and terminated at the other end of the series by first and last flexible, biasable outer units 19 and 21 (FIG. 1). Each inner unit 18 includes outer substantially parallel side strands, portions 24 and 26 which are joined by substantially parallel inner double cross strands 34 and 36. The outermost end cross strands 48 and 50 are single strands. The inner and outer units can be made into any dimensions according to the kind of exercise the apparatus is to be used for. Thus, two opposed side strands 20 and 22 extend spaced substantially parallel and are joined at spaced intervals by double cross strand members 34 and 36 and at the ends by first and second end cross strands 48 and 50. As described, all cross and side strands are preferably made of a single strand 56 joined by cross knots 58 and first knot 60.

The embodiment of the invention particularly disclosed and described herein above is presented merely as an example of the invention. Other embodiments, forms and modifications of the invention coming within the proper scope and spirit of the appended claims will, of course, readily suggest themselves to those skilled in the art. These modifications and improvements include, and the present invention specifically covers, the use of a double ring or strand of tubing (such as shown adjacent the hands of the user) shown in FIG. 1 of the annexed drawings. A principal advantage of this feature of doubling the strands is the protective aspect of preventing injury should one of the strands break or become fatigued. In such an event, the remaining strand or loop will more than compensate for the lost loop.

What is claimed is:

1. An exerciser apparatus, in combination, comprising:

a single elastic linear tubular strand having two ends disposed to provide, a pair of opposed, elongated elastic side strands, elastic end cross-strands joining said side strands, a plurality of ecross-strand means joining said side strands at intervals between said end cross-strands, each of said inner cross-strand means including two adjoining portions of said single elastic linear strand, a plurality of gripping means enclosing said end cross-strands and said inner cross-strand means for providing grips for a user, portions of said single linear strand being joined at a cross-knot at said inner cross-strand means, and said two ends of said single linear strand being joined at a final knot at one of said end cross-strands.

2. An exercise apparatus according to claim 1, wherein said tubular strand is elastic rubber.

3. An exercise apparatus according to claim 1, wherein said tubular strand is elastomer.

4. An exerciser apparatus according to claim 1, wherein said gripping means is a flexible tubular member.

5. An exercise apparatus according to claim 4, wherein each of said gripping means enclosing said end cross strands is a reinforced flexible tubular gripping member, and further including means attached to said reinforced flexible member for detachably connecting said apparatus to the opposite side of a closed door.

6. An exercise apparatus according to claim 5, wherein said means for detachably connecting said apparatus to the opposite side of a door includes a flat, flexible connector having an aperture at one end, a bracing member forming a compartment, said compartment having an open portion at said other end, and filler means contained in said compartment, whereby said connector can be wrapped around said reinforced gripping member via said aperture and said connector can be placed under or over a door with said bracing member on the opposite side of said door and with said door can

* * * * *